US010174598B2

(12) United States Patent
Sprouse

(10) Patent No.: US 10,174,598 B2
(45) Date of Patent: Jan. 8, 2019

(54) TIGHT-SHALE OIL PRODUCTION TOOL

(71) Applicant: GAS TECHNOLOGY INSTITUTE, Des Plaines, IL (US)

(72) Inventor: Kenneth M. Sprouse, Northridge, CA (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 509 days.

(21) Appl. No.: 14/776,134

(22) PCT Filed: Mar. 28, 2013

(86) PCT No.: PCT/US2013/034386

§ 371 (c)(1),
(2) Date: Sep. 14, 2015

(87) PCT Pub. No.: WO2014/143075

PCT Pub. Date: Sep. 18, 2014

(65) Prior Publication Data

US 2016/0032699 A1 Feb. 4, 2016

Related U.S. Application Data

(60) Provisional application No. 61/785,307, filed on Mar. 14, 2013.

(51) Int. Cl.

| | |
|---|---|
| ***E21B 36/02*** | (2006.01) |
| ***E21B 43/24*** | (2006.01) |
| ***E21B 43/26*** | (2006.01) |

(52) U.S. Cl.

CPC ..... *E21B 43/24* (2013.01); *E21B 43/26* (2013.01)

(58) Field of Classification Search

None

See application file for complete search history.

(56) References Cited

U.S. PATENT DOCUMENTS

| | | | | |
|---|---|---|---|---|
| 3,595,316 | A * | 7/1971 | Myrick, III | E21B 36/00 166/303 |
| 3,605,885 | A * | 9/1971 | Leeper | E21B 36/025 122/136 R |
| 3,982,591 | A * | 9/1976 | Hamrick | E21B 34/16 166/302 |
| 4,077,469 | A * | 3/1978 | Hamrick | E21B 34/16 166/59 |
| 4,861,263 | A | 8/1989 | Schirmer | |
| 5,832,999 | A * | 11/1998 | Ellwood | E21B 36/02 166/256 |
| 7,572,303 | B2 | 8/2009 | Orr | |
| 2010/0282644 | A1 | 11/2010 | O'Connor et al. | |
| 2011/0127036 | A1 | 6/2011 | Tilmont et al. | |
| 2011/0214858 | A1* | 9/2011 | Castrogiovanni | E21B 36/02 166/272.1 |
| 2012/0067568 | A1* | 3/2012 | Palmer | E21B 36/02 166/256 |

FOREIGN PATENT DOCUMENTS

WO WO 2011/112513 A2 9/2011

* cited by examiner

*Primary Examiner* — Angela M DiTrani Leff

(74) *Attorney, Agent, or Firm* — Pauley Erickson & Kottis

(57) ABSTRACT

A tight-shale oil production tool includes a combustor operable to generate an aqueous-phase nitric acid, combustion products.

19 Claims, 4 Drawing Sheets

TIGHT-SHALE OIL PRODUCTION TOOL

Applicant hereby claims priority to U.S. Patent Application No. 61/785,307 filed Mar. 14, 2013, the disclosure of which is herein incorporated by reference.

BACKGROUND

The present disclosure relates to a tight-shale oil production system, and more particularly to a down-hole compact liquid rocket engine style combustor production tool.

There is significant commercial interest in the recovery of methane gas from shale since the technological advancements in horizontal drilling and hydraulic fracturing have extended the domestic supply of natural gas within the United States of America. Although tight shale gas deposits are economically viable for commercial development, the technology to produce crude oil from tight-shale "source rock" formations using hydraulic fracking methods continue to be developed.

Previous methods have used relatively simple reservoir flooding with low temperature acids, oxygen and water (for in-situ kerogen/oil combustion outside of the injection well), or low temperature carbon dioxide gas. These methods may not be economical.

BRIEF DESCRIPTION OF THE DRAWINGS

Various features will become apparent to those skilled in the art from the following detailed description of the disclosed non-limiting embodiment. The drawing that accompanies the detailed description can be briefly described as follows.

DETAILED DESCRIPTION

Figure 1:
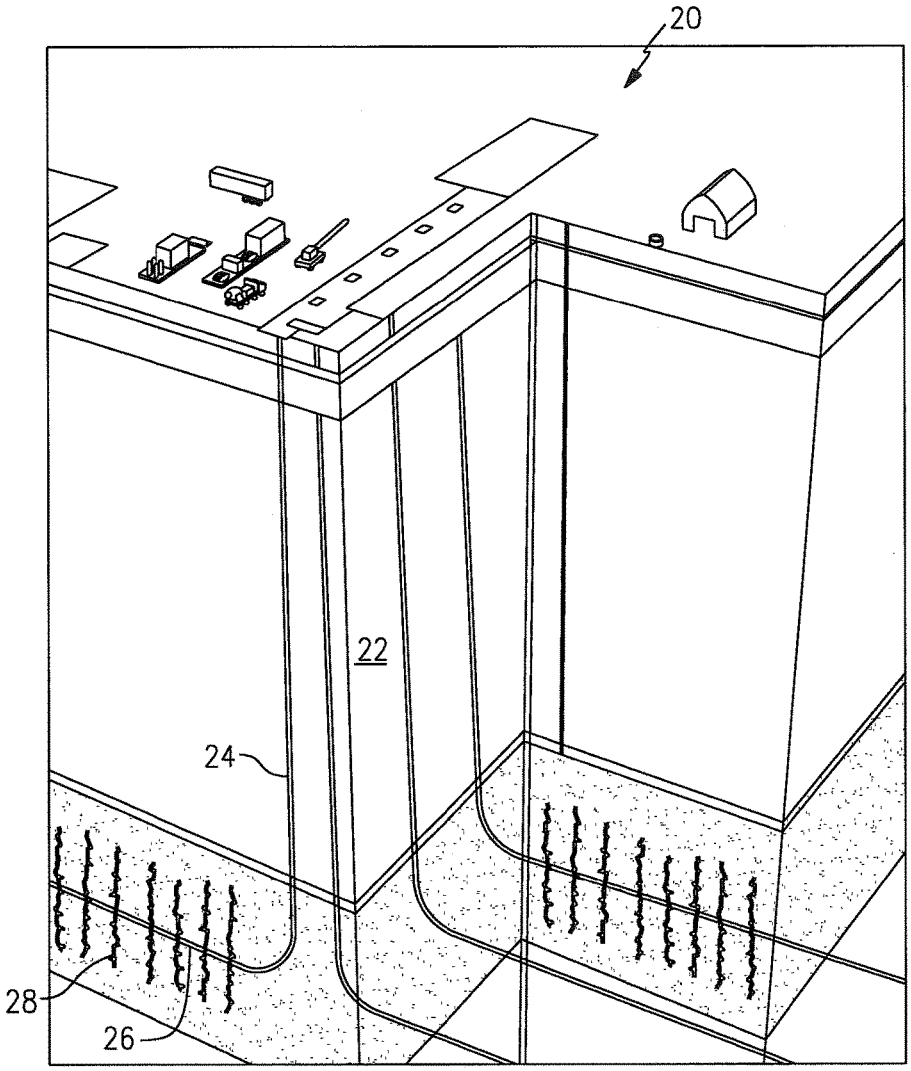
FIG. 1 is a schematic view of Tight-Shale Oil Production.

Fossil fuels are derived from cellulose (the organic material of plants and algae) that may be described as a solid organic polymer, $(—C_6H_{10}O_5—)_n$(cell). The carbon bonds within this polymer are all saturated single bonds so that the polymer itself is highly energetic and can form many different compounds during decomposition. For example, a global cellulose decomposition reaction can be written here as:

$$(—C_6H_{10}O_5—)_n(\text{cell}) \rightarrow x(—CH_a—)_n(ker) + \frac{5\,n}{2}CO_2(g) + n\ y\ CH_4(g) + y(—CH_2—)_{nb}(\text{oil}) \quad \text{(R1)}$$

where $(—CH_a—)_n$(ker) denotes a solid kerogen phase unsaturated polymer (i.e., a highly aromatic organic material with most carbon atoms containing double bonds), $CO_2$(g) is carbon dioxide gas, $CH_4$(g) is gaseous methane, and $(—CH_2—)_{nb}$ (oil) denotes an oil phase saturated organic polymer (alkane or olefin) which can be either a liquid or solid depending upon the molecular weight of the polymer and its temperature/pressure condition. In Reaction R1, the stoichiometric parameters (a, b, x, and y) have the following values.

$$0 \le a \le 1.2 \quad (1)$$

and:

$$0 \le b \le \frac{4}{3} \quad (2)$$

and:

$$x = \frac{(4-3b)}{[(4-a)+b(2-a)]} \quad (3)$$

and:

$$y = \frac{\left(10-\frac{7}{2}a\right)}{[(4-a)+b(2-a)]} \quad (4)$$

The constant, a, is determined by the age and environmental severity of the kerogen's aging process. Younger and less severe aging conditions leads to diagenesis kerogens with a value for the constant, a, typically greater than 1.0. The oldest and most severely cracked kerogens are known as metagenesis kerogens with a value for the constant, a, approaching 0.0 (i.e., essentially pure graphite or coke). In between these two extremes are catagenesis kerogens where the constant, a, is in the 0.6 to 0.8 range. These kerogen ranks are analogous to those used to describe much younger coal. For example, diagenesis kerogen is analogous to lignite and sub-bituminous coal. Catagenesis kerogen is analogous to bituminous coals while metagenesis kerogen is analogous to anthracite coal. The atomic hydrogen-to-carbon ratios, a, in these kerogen ranks are similar to coal except that coal is more oxygenated—having atomic oxygen-to-carbon ratios in the 0.06 range while kerogens are closer to zero.

The constant, b, provides the stoichiometric split between the produced oil and natural gas. When the constant, b, is zero only natural gas is produced during the cellulose decomposition. The maximum amount of oil is produced (in relation to natural gas) when the constant, b, equals 4/3. Under these decomposition conditions, no kerogen is being made—only gas and oil as seen from Equations 3 and 4.

Reaction R1 assumes that all cellulosic oxygen ends up as carbon dioxide gas, $CO_2$(g). During the initial stages of cellulose decomposition this is usually not the case since thermodynamic considerations show that oxygenated organic liquids can also be produced. These oxygenated organic liquids are the alcohols, $H(—CH_2—)_nOH$; the organic acids, $H(—CH_2—)_n$ COOH; the aldehydes, $H(—CH_2—)_nCHO$; the esters (or vegetable oils), $H(—CH_2—)_mCOO(—CH_2—)_nH$; and the ketones, $H(—CH_2—)_mCO(—CH_2—)_nH$.

Under continued elevated temperatures, thermodynamics shows that these organic liquids will themselves decompose into oil, methane, hydrogen, water, and carbon dioxide according to the following five reactions:

alcohols:

$$H(—CH_2—)_nOH \rightarrow (—CH_2—)_n(oil)+H_2O \quad (R2)$$

organic acids:

$$H(—CH_2—)_nCOOH \rightarrow (—CH_2—)_n(oil)+H_2+CO_2 \quad (R3)$$

aldehydes:

$$H(—CH_2—)_nCHO \rightarrow (—CH_2—)_n(oil) + \frac{1}{2}CH_4 + \frac{1}{2}CO_2 \quad (R4)$$

esters:

$$H(—CH_2—)_mCOO(—CH_2—)_nH \rightarrow (—CH_2—)_m(oil)+ (—CH_2—)_n(oil)+H_2+CO_2 \quad (R5)$$

and ketones:

$$H(—CH_2—)_mCO(—CH_2—)_nH \rightarrow (—CH_2—)_m(oil) + (—CH_2—)_n(oil) + \frac{1}{2}CH_4 + \frac{1}{2}CO_2 \quad (R6)$$

Hence, to be complete; the overall cellulose decomposition reaction, Reaction R1, should also include some product hydrogen and water to account for the intermediate alcohol, acid, and ester decomposition pathways. Since these two species are expected to subsequently react with the kerogen and oil product species to produce more natural gas and carbon dioxide, we will continue to ignore hydrogen and water as product species in Reaction R1.

It should be further noted that the biofuels industry is attempting—through improved cellular genetics and biological fermentation bacteria—to maximize the production of the oxygenated organic liquids shown above from plant and algae cellulosic source materials.

When "saturated" liquid water, $H_2O(aq)$, at nominal temperatures of 450 to 700 F (232-371 C) [which requires fluid pressures greater than 430 to 3,100 psia (30-214 atm) as seen from the saturated steam tables of Perry and Chilton, *Chemical Engineers' Handbook,* 5$^{th}$ Ed., McGraw-Hill, New York (1973)] is present within the shale formation, the following reaction with the solid kerogen organic polymer will occur—if the fluid pressure is lower than saturation, the following reaction will not occur:

$$(—CH_a—)_n(ker)+nuH_2O(aq) \rightarrow nvCO_2(g)+nwCH_4(g)+w(—CH_2—)_{nc}(oil) \quad (R7)$$

In Reaction R7, the stoichiometric constants (c, u, v, and w) are given by the following equations.

$$0 \leq c \leq \infty \quad (5)$$

and:

$$u = \frac{(4-a)+c(2-a)}{(4+3c)} \quad (6)$$

and:

$$v = \frac{(4-a)+c(2-a)}{(8+6c)} \quad (7)$$

and:

$$w = \frac{(4+a)}{(8+6c)} \quad (8)$$

The constant, c, provides the stoichiometric split between the produced oil and natural gas from the kerogen hydrous cracking reaction, Reaction R7. When the constant, c, is zero; only natural gas is produced during kerogen hydrous cracking—i.e., no oil. When the constant, c, is infinity; only oil is produced from Reaction R7—i.e., no natural gas.

As mentioned above; the molecular weight of the oil phase polymers, $(—CH_2—)_{nc}(oil)$, can range from small values of 56 g/mol (e.g., C4 olefins and alkanes) to very large values of 1,000 g/mol (C70 olefins and alkanes) and above depending upon the product value of "nc" (which is the numerical number in the C4, C70 designations). As the molecular weight of the olefin/alkane polymer increases, its liquid viscosity (at a given temperature) also increases until the polymer changes from a liquid to a solid having infinite viscosity. Typically, an olefin/paraffin polymer will not flow if its molecular weight is above 400 g/mol (>C30s) at the 450 to 700 F reaction temperatures considered above.

The "saturated" liquid water, $H_2O(aq)$, which acts on the kerogen in Reaction R7 can also react with the oil to break-up the olefin/alkane polymers according to following hydrous cracking reaction:

$$(—CH_2—)_{(m+n+4)}(oil)+2H_2O(aq) \rightarrow (—CH_2—)_m(oil)+ (—CH_2—)_m(oil)+3CH_4(g)+CO_2(g) \quad (R8)$$

In Reaction R8 two smaller oil polymers, $(—CH_2—)_m(oil)$ and $(—CH_2—)_n(oil)$, have been made from one larger polymer, $(—CH_2—)_{(m+n+4)}(oil)$, along with methane and carbon dioxide gas. Again if the fluid pressure is below saturation conditions, Reaction R8 will not occur in the 450 to 700 F temperature range.

It should be noted that temperatures held above 600 F for long periods of time will also cause the produced oil to coke according to:

$$(—CH_2—)_2(oil) \rightarrow CH_4(g)+C(coke) \quad (R9)$$

The solid coke produced from Reaction R9 will subsequently return to the kerogen phase and lower the value of its polymer constant, a.

Finally, since most of the saturated liquid water in these oil reservoirs is a slightly basic brine solution, the high pressure carbon dioxide product gas, $CO_2(g)$, from the above reactions will react with the dissolved and suspended solids within this brine solution to precipitate solid carbonate rock such as limestone [$CaCO_3(s)$], dolomite [$MgCO_3/CaCO_3(s)$], or a multitude of other mineral combinations. For example, $$CO_2(g)+Ca^{+2}(aq)+2OH^-(aq) \rightarrow CaCO_3(s)+H_2O(aq) \quad (R10)$$

Hence, the amount of carbon dioxide gas found within tight shale formations where brine is also present is typically very low.

The chemical thermodynamics that support the use of Reactions R1 through R10 in the 450 to 700 F (232-371 C) temperature range can be found from the standard state Gibbs free energies of formation, entropies and specific heats for an i$^{th}$ species—i.e., $\Delta_f G°$ (i), S° (i), and $c_p°$ (i) respectively—as provided in references such as Wagman et al., "The NBS Tables of Chemical Thermodynamic Properties (Selected Values for Inorganic and C1 and C2 Organic Substances in SI Units)," *J. Phys. Chem. Ref Data,* 11

(Suppl. No. 2), American Chemical Society, New York (1982). For the C3 and above organic species shown in Reactions R1 through R10 but not found in Wagman, the values for their $\Delta_f G°$ (i), S° (i), and $c_p°$ (i) can be readily calculated from heats-of-combustion $\Delta_c H°$ data given in Perry and Chilton (or generated from American Society for Testing and Materials, ASTM, calorimeter tests per ASTM Procedure D5865-07 or equivalent) and the additive rules for S° (i) and $c_p°$ (i) found in these references.

With reference to FIG. 1, a tight-shale oil production well system 20 for the production of natural gas, $CH_4$(g), from tight-shale formations is schematically illustrated. The well system 20 includes numerous wells 22 each with one or more vertical sections 24 and horizontal sections 26 that have been drilled through the shale formation. Each well may be spaced approximately 2,000-ft from each other.

At the surface, each vertical section 24 is drilled vertically downward until the shale deposit is reached at depths nominally between 5,000 to 14,000-ft (1524-4268 m). At this point the well's direction is changed and the horizontal section 26 is directed to follow the shale seam. In many cases the horizontal section 26 may extend up to another 5,000-ft (1524 m) or more. If the shale seam is not deposited horizontally but pitched at an angle to the horizontal direction, the horizontal section 26 is slant-drilled at the same angle as the shale formation to follow the seam.

Next, the horizontal section 26 are fracked and propped (using standard hydraulic fracturing methods; illustrated schematically at 28) to create radial-disk arteries within the shale formation. These propped radial-disks arteries typically may have 1,000-ft (304 m) radii and thicknesses of approximately 0.1-inch (2.5 mm) Once these wells are completed, the high pressure (4,000 psia; 272 atm) natural gas, $CH_4$(g), will begin flowing out of the shale's matrix and into the radial-disk arteries before entering the well's nominal 8-inch piping for subsequent transfer to the earth's surface (at 14.7 psia; 1 atm pressure) over distances of miles.

The driving pressure for the natural gas is the reservoir fluid's static pressure, P, which at depths over 5,000-ft (1524 m) is typically above 4,000 psia (272 atm). The porosity, ε, of tight-shale formations is nominally 4 to 12 vol %. This void volume is filled with kerogen, oil, natural gas, and water (i.e., aqueous brine). The permeability, ξ, of this tight-shale is nominally 0.1-microdarcy (or 0.1-μd)—where 1.0 darcy=0.987 $\mu m^2$. Finally, the shale's nominal pore radius, r, is approximately 0.05-μm (microns). The tight-shale physical parameters (porosity, permeability, and pore radius) make it very difficult for the natural gas to exit the shale formation when the fracked and propped production wells are installed—even at 4,000 psia (272 atm) driving fluid pressures, P. For the shale's oil, it is virtually impossible to escape. The low values for these three physical parameters are directly related to the principal consolidation compressive stress, $\sigma_s$, within the shale's rock—which runs at approximately 5,000 psi (340 atm) or higher at these depths of 5,000 to 14,000-ft (1524-4267 m).

The main restriction that prevents the free flow of natural gas, oil, and brine water through the tight-shale, aside from its low permeability, is interface surface tension, γ, among these three phases. For example, the aqueous/oil interface surface tension, $\gamma_{aq/oil}$, is approximately 45 dynes/cm; the oil/gas interface surface tension, $\gamma_{oil/g}$, is about 30 dynes/cm, and the aqueous/gas interface surface tension, $\gamma_{aq/g}$, is between 30 to 70 dynes/cm. At each $j^{th}$ interface encountered within a shale's pore, the fluid pressure differential, $\Delta P_j$, across that interface—which must be additively applied to begin moving the fluid through the pore—is given by:

$$\Delta P_j = \frac{2\gamma_j \cos\theta_j}{r_j} \tag{9}$$

where $r_j$ is the effective pore radius at the $j^{th}$ interface, and $\theta_j$ is the contact wetting angle at the $j^{th}$ interface. The wetting angle is measured between the pore's solid surface and the interface surface of the two fluid phases. For most solid surfaces in which the fluid phases have been in contact for long periods of time, the contact wetting angle will be essentially 0.0 degrees.

Using Equation 9 and the numerical values above for its parameters, it can be seen that the average static pressure differential across each interface is about 260 psid. Hence, if a single pore has on average 2 or 3 interfaces within it, one will need to produce a minimum 780 psid pressure differential across its length before the trapped fluid inside the pore will even begin to move. The fluid's pore velocity, $v_p$, within the tight shale is subsequently given by:

$$v_p = \frac{\xi}{\hat{\mu}\varepsilon}\frac{\left(\Delta P_t - n_p \Delta \hat{P}_j\right)}{\Delta L} \tag{10}$$

where $n_p$ is the average number of phase interfaces within a pore, $\Delta \hat{P}_j$ is the average pressure drop across a single interface within the pore, $\Delta P_t$ is the total static pressure drop across a pore, ΔL is the total length of the pore, and $\hat{\mu}$ is the average fluid viscosity within the pore given by:

$$\hat{\mu} = \frac{1}{\Delta L}\sum_j \mu_j \Delta L_j \tag{11}$$

where $\Delta L_j$ is the length between phase interfaces of jth fluid. For completeness, it should be noted that:

$$\Delta L = \sum_j \Delta L_j \tag{12}$$

If the average single pore length is about 0.1-ft (30 mm) containing a multi-phase fluid having an average fluid viscosity from Equation 11 of 0.2-centipoise at 600 F (315 C), then using Equation 10 with the parameters above will show that applying a 5,000 psid (340 atm differential) total pressure differential across the pore will produce a fluid velocity within the pore, $v_p$, of approximately $8\times10^{-6}$ ft/sec. Although this is an extremely low number, it is consistent with the superficial fluid leak-off velocities encountered during hydraulic fracturing of tight shale.

As aqueous water reacts with kerogen and heavy oil according to Reactions R7 and R8 above, it produces gas phase methane, $CH_4$(g), and carbon dioxide, $CO_2$(g), within the shale's pores. This produced gas phase has an isothermal compressibility, $\kappa_g$, that is inversely proportional to the static fluid pressure, P; i.e.:

$$\kappa_g = \frac{1}{P} \tag{13}$$

For the oil and aqueous water liquid phases; the isothermal compressibility factor, κ—defined generally as:

$$\kappa \equiv \frac{1}{\rho}\frac{\partial \rho}{\partial \rho}\bigg|_T \tag{14}$$

where ρ is the fluid density, and T is the temperature—is typically 3 to 30 times lower than the compressibility factor for the gas phase at the nominal temperature and pressure conditions within the pore of 450-600 F and 4,000-12,000 psia respectively. This implies that Reactions R7 and R8 produces a high pressure gas within the shale's individual sub-micron pores (r=0.05-μm) that has enough expansion capability (due to the higher compressibility factor) to drive the oil and aqueous fluids out of these pores and into the larger connecting micron pores (r>1.0-μm) and fissures for transfer to the production wells.

Figure 2:
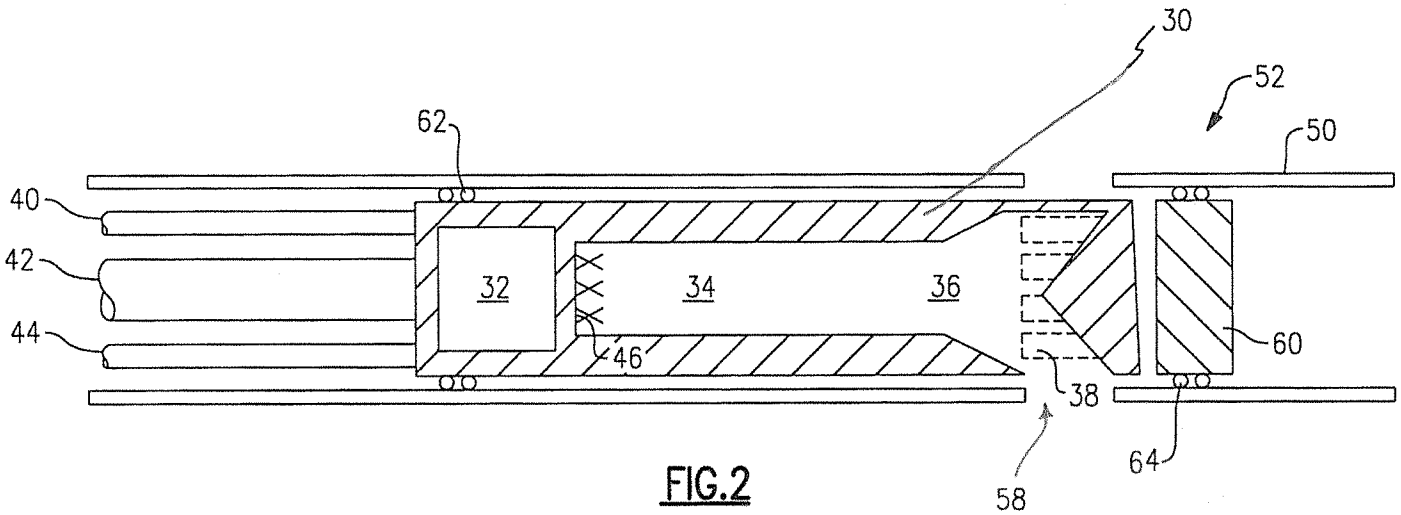
FIG. 2 is a schematic view of a down-hole Tight-Shale Oil Production Tool according to one disclosed non-limiting embodiment.

With reference to FIG. 2, a tight-shale oil production tool 30 generally includes an injection manifold 32, a combustor 34, a quench section 36 and a multiple of slot holes 38. The injection manifold 32 is upstream of the combustor 34 which is upstream of the quench zone 36 such that combustion products therefrom are directed outward thorough the slot holes 38. The tight-shale oil production tool 30 is relatively compact with, for example, a 5-inch inside diameter. The tight-shale oil production tool 30 in one disclosed non-limiting embodiment provides a high mass flow rate (600 lbm/s) combustor 34 for long life operation at 9,000 psia (612 atm) chamber pressures which produce 700 F (371 C) nitric acid effluents.

A flexible fuel line 40, water line 42 and oxidizer line 44 communicate with the injection manifold 32 for operations as a down-hole compact liquid rocket engine style combustor that is fueled by, for example, an anhydrous ammonia, $NH_3$ and high purity oxygen, $O_2$, (at greater than 98 volume %) at stoichiometric combustion conditions. For improved flame stability and lower oxygen consumption; natural gas, $CH_4$, may also be included with the anhydrous ammonia fuel.

The combustor 34 may be cooled and the combustion products therefrom quenched with filtered reservoir water or brine directly from the oil field from which suspended solids have been removed. Sufficient reservoir water/brine is added so that the effluent that exits the quench section 36 is high temperature 700 F (371 C) aqueous-phase nitric acid, $HNO_3$ (aq). Should higher concentrations of nitric acid be desirable, the additional nitric acid may be injected into the reservoir water prior to suspended solids filtering and injection into the quench section 36. The combustor 34 oxidizer and water quench streams are staged so that all of the ammonia fuel via temperature control is converted directly to nitric acid via the global reaction:

$$NH_3+2O_2 \rightarrow HNO_3(aq)+H_2O(aq) \tag{R11}$$

If methane is included in the fuel for combustion stability, some carbonic acid, $H_2CO_3$(aq), will also be produced—however, most of the carbon within this fuel will still exit the combustor 34 as carbon dioxide gas, $CO_2$(g). This gas may be undesirable due to its propensity to produce limestone, dolomite, and other solids that could possibly plug the shale's micron and sub-micron pores as well as creating more gas/oil and gas/aqueous phase-interfaces that increase the pore pressure drops for removing oil as shown in Equations 9 and 10 above.

The reactant flow rates for tool 30 is set by the tight-shale's fracking parameters which include not only the shale permeability but also the shale's hydraulic fluid fracking pressure, $P_f$, the shale's nominal reservoir fluid pressure, $P_r$, and the shale's effective axial leakage distance, $\Delta z_1$. Both the hydraulic fluid fracking pressure, $P_f$, and nominal reservoir fluid pressure, $P_r$, are functions of the tight shale's depth. At reservoir depths of 5,000-ft (1524 m), the fracking pressure, $P_f$, is about 9,000 psia (612 atm) while the nominal fluid reservoir pressure, $P_r$, is about 4,000 psia (272 atm). The effective axial leakage distance, $\Delta z_1$, has been found to be on the order of 0.4-inch (10 mm) for some tight shales. Using these parameters, the volumetric flow rate of aqueous nitric acid from the invention's down-hole combustor, $\dot{Q}_{in}$, can be related to the fracture distance of the vertical crack, $r_f$, produced in the tight shale reservoir according to:

$$\dot{Q}_{in} = \frac{2\pi\xi r_f^2(P_f - P_r)}{\mu\Delta z_1} \tag{15}$$

In hydraulic fracking of tight shales having permeabilities, ξ, of 0.1-μd; industry has produced radial cracks out to a fracture distance, $r_f$, of 1,000-ft when using ambient temperature water with a density of 62.4 lbm/ft$^3$ and a viscosity of 1.0-centipoise (cp) at a flow rate, $\dot{Q}_{in}$, of approximately 80-bbl/min (barrels per minute). If the temperature and pressure of the aqueous acid exiting the combustor's quench section is 700 F and 9,000 psia respectively, then the viscosity and density of the injected liquid is approximately 0.1-cp and 42.3-lbm/ft$^3$, respectively. Using these values, Equation 15 shows that a fracture distance, $r_f$, of only 400-ft can be produced from a volumetric flow rate, $\dot{Q}_{in}$, of 118-bbl/min of 700 F aqueous acid (which is equivalent to the 80-bbl/min given above when referenced back to ambient surface temperature conditions of 70 F).

To produce a volumetric flow rate, $\dot{Q}_{in}$, of 118-bbl/min at 700 F and 9,000 psia; the reactant flow rates to the tight-shale oil production tool 30 are approximately:

| | |
|---|---|
| Anhydrous Ammonia | 40.2 lbm/s |
| Oxygen (99 vol % purity) | 151 lbm/s |
| Produced water/brine | 458 lbm/s |

Alternatively, the oxygen may be supplied with a relatively smaller air separation unit (ASU) such that the anhydrous ammonia may be switched to methane gas to lower the oxygen consumption to 54 lbm/s (about 3 times lower). Here, the methane flow rate (to replace the anhydrous ammonia) would be 13.4 lbm/s. A switch to pure hydrogen, $H_2$, as the fuel may alternatively or additionally be effected to still further reduce the oxygen consumption from the ASU even further to 45 lbm/s—with the hydrogen flow rate (to replace either the anhydrous ammonia or methane) at 5.6 lbm/s. In both cases of switching the fuel from anhydrous ammonia to either methane of hydrogen, the required nitric acid be added completely to the aqueous produced water phase.

Figure 3:
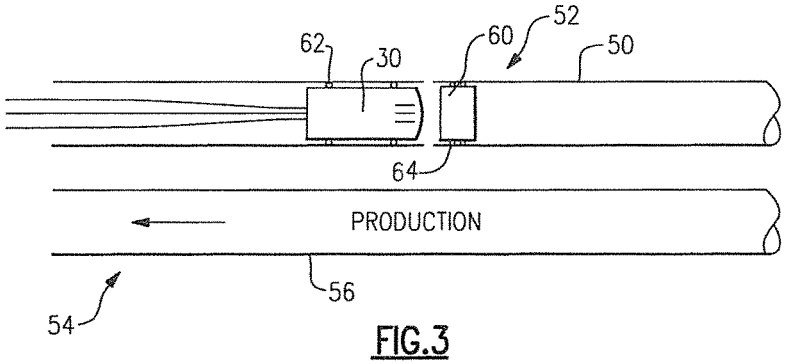
FIG. 3 is a schematic view of a horizontal well section of the Tight-Shale Oil Production Device according to one disclosed non-limiting embodiment.
Figure 4:
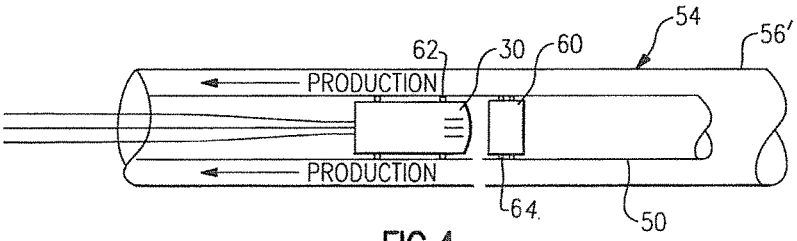
FIG. 4 is a schematic view of a horizontal well section of the Tight-Shale Oil Production Device according to another disclosed non-limiting embodiment.

The tight-shale oil production tool 30 moves through an injection well casing 50 of an injection well 52. Each injection well 52 may be associated with a respective production well 54 and production well casing 56 located adjacent thereto (FIG. 3). Alternatively, the injection well 52 may be located within a surrounding coaxial production well casing 56' (FIG. 4).

The ammonia fuel and oxygen may be injected at a combustor face plate 46 of the combustor 34 to produce steam, $H_2O(g)$, and nitrogen dioxide, $NO_2(g)$. The water and balance of the oxidizer are staged into the quench section 36 to ensure all product nitrogen dioxide is converted to nitric acid before ejection through prior formed perforations 58 in the injection well casing 50 at 700 F and the tight shale's hydraulic fracking pressure, $P_f$, on the order of 9,000 psia.

The tight-shale oil production tool 30 is isolated within the injection well casing 50 by a packer 60. The packer 60 and tight-shale oil production tool 30 include respective seal packages 62, 64 to provide a tight seal arrangement inside the injection well casing 50 so that the 700 F aqueous liquid is forced out of the perforations 58 between the respective seal packages 62, 64.

Figure 5:
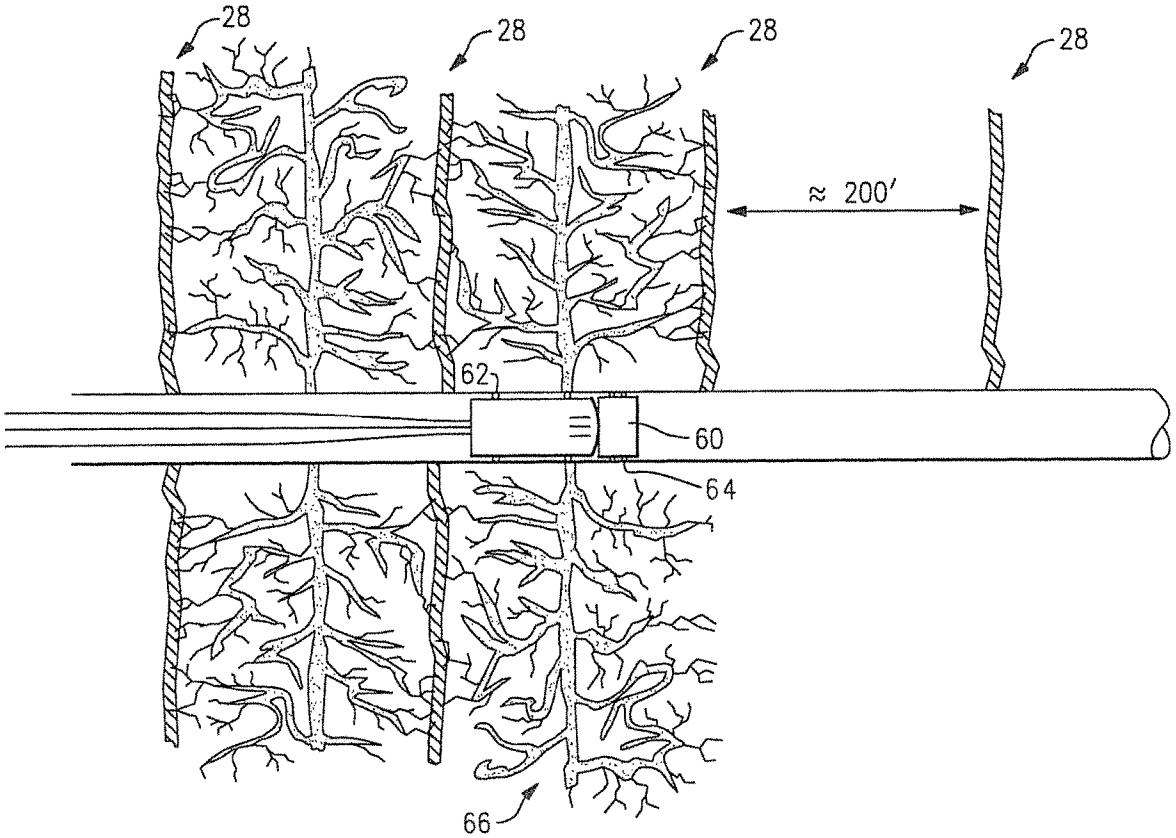
FIG. 5 is a schematic view of the Tight-Shale Oil Production Tool in operation.

With the production well turned-off, the tight-shale oil production tool 30 within the injection well casing 50 is positioned between two adjacent fracked and propped radial cracks that may be, for example, approximately 200-ft (61 m) apart (FIG. 5). At this time the tight-shale oil production tool 30 is continuously operated over a period of time to heat the shale and introduce high temperature nitric acid into the shale reservoir's fluid. The high pressure nitric acid forms its own vertically oriented radial crack (or fracture) 66 which subsequently introduces the nitric acid into the zone between the two adjacent fracked and propped radial cracks. To cover the 200-ft (61 m) between the two adjacent fracked and propped radial cracks 28, it is expected that the tight-shale oil production tool 30 will be continuously operated for a period of 6 to 10 days in a heating operation.

After conclusion of the heating operation, the tight-shale oil production tool 30 is moved within the injection well casing 50 and re-positioned between a different pair of adjacent fracked and propped radial cracks 28. With the production wells turned off in this location, the tight-shale oil production tool 30 will again be operated for a period of 6 to 10 days for heating the shale and spreading high pressure high temperature nitric acid within the zone between the two new adjacent fracked and propped cracks.

After a zone is heated and flooded with high-temperature high-pressure nitric acid, it is allowed to sit in a static condition while the hydrous Reactions R7 and R8 are allowed to run their course to produce light oil and methane gas—which will also increase the pore pressures well beyond the hydraulic fracking pressure, $P_f$, of 9,000 psia (620 atm) due to the creation of lower density methane and carbon dioxide gases.

During this static soak period, the strong nitric acid, $HNO_3(aq)$, will react with the oil phase to produce carboxylic acid, $H(—CH_2—)_s$ COOH, and weak nitrous acid, $HNO_2(aq)$, according to the following reaction:

$$(—CH_2—)_m(\text{oil})+2HNO_3(aq)\rightarrow(\text{oil})H(—CH_2—)_s COOH(aq)+(—CH_2—)_{(m-s-1)}(\text{oil})+2HNO_2(aq) \quad (R12)$$

The production of carboxylic acid, $H(—CH_2—)_sCOOH$, is important as a surfactant for lowering the surface tension between the oil and aqueous phases. As seen in Reaction R12, the carboxylic acid is written showing the polymer's oil phase tail, $HCH_2$—, and its aqueous acid phase head, —COOH. This acid, acting as a surfactant, can significantly lower the aqueous/oil interface surface tension, $\gamma_{aq/oil}$, from its nominal value of 45 dynes/cm (as given above) to nearly 1 dyne/cm. Such a reduction in surface tension will have a profound effect on the fluid pressure differential terms, $\Delta P_j$, calculated in Equation 9 and used to determine the fluid pore velocity, $v_p$, in Equation 10.

Since nitric acid is an extremely strong acid, it is the primary product species from the quench section 36 used for reducing the aqueous/oil interface surface tension. To some extent the carbon dioxide gas may have a minor but contributing role in the production of carboxylic acid since at high fluid pressures of 9,000 psia (620 atm) some of the carbon dioxide gas will react with the water to form carbonic acid, $H_2CO_3(aq)$, according to:

$$CO_2(g)+H_2O(aq)\rightarrow H_2CO_3(aq) \quad (R13)$$

This carbonic acid can then produce more carboxylic acid surfactant from the oil phase from the following chemical reaction:

$$(—CH_2—)_m(\text{oil}) + \frac{2}{3}H_2CO_3(aq) \rightarrow (\text{oil})H(—CH_2—)_sCOOH(aq) + (—CH_2—)_{(m-s-1/3)}(\text{oil}) \quad (R14)$$

Since carbonic acid is a relatively weak acid, the production of carboxylic acid from Reaction R14 is not expected to be very pronounced.

The production of methane and carbon dioxide gas from Reactions 7 and 8 will lower the oil/gas interfacial surface tension, $\gamma_{oil/g}$, from 30 dynes/cm (as shown above) to the range of 1 dyne/cm. This is due to the fact that at fluid static pressures above 5,000 psia both methane and carbon dioxide gas are miscible in oil. Hence, as seen with aqueous/oil interface surface tension, $\gamma_{aq/oil}$ this invention will also lower the oil/gas interface surface tension, $\gamma_{oil/g}$, to values which make it much easier to remove the trapped oil and gas contained within the shale's sub-micron pores as determined by Equations 9 and 10. However, as noted earlier; carbon dioxide gas is also detrimental in the production of limestone and dolomite that could plug the micron and sub-micron pores should the reservoir's brine solution contain appreciable amounts of dissolved calcium and magnesium.

Finally, during operation of the tight-shale oil production tool 30 and subsequent soak period, the temperature of the fluid and shale rock are heated to a final bulk temperature above 450 F (232 C). At these temperatures, the average fluid viscosity from Equation 11 will be substantially reduced thus allowing a faster expulsion rate (i.e., higher pore velocity, $v_p$) from the pores as shown by Equation 10. This substantial reduction in fluid viscosity is due to the oil phase which can change viscosity in the 100 to 400 F (37-204 C) temperature range by over an order of magnitude—for high molecular weight C30 and above oils.

After the soak period is completed, valves to the production well are opened to allow the pressurized oil, gas and aqueous brine to flow into the production well casing for transport to the well's surface. The driving pressure for this transport is primarily from the generated methane and carbon dioxide gases produced during the soak period to pressures in excess of 12,000 psia (816 atm). The compressibility of these gases generate a substantial volume of produced oil, gas, and brine before the local static pressure between the two adjacent fracked and propped cracks 28 is reduced back to the nominal reservoir static fluid pressure of 4,000 psia. This $CH_4/CO_2$ gas driver (from Reactions R7 and R8) is necessary to produce the pressures and expansion volume necessary for delivery of the kerogen's produced oil to the well's surface.

The tight-shale oil production tool 30 and injection well casing 56 may be manufactured from materials that have excellent corrosion resistance to nitric acid such as Austenitic stainless steels in the 300 series and zirconium alloys. The cooling circuits (not shown) may be used with the reservoir's produced water that is cooled to temperatures below 80 F (26 C) at the surface before being pumped to 9,000 psia (620 atm) for delivery to the tight-shale oil production tool 30 at nominal depths exceeding 5,000-ft (1524 m). The cooling circuits may utilize, for example, slotted channel liners and film cooling methods to maintain temperatures below, for example, 250 F (121 C).

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A process to recover oil, comprising:

combusting a fuel and oxidizer in a presence of water to generate a combustion product having aqueous nitric acid and water, wherein the combustion product has a pressure of at least approximately 10 k psi;

injecting the combustion product into a tight shale reservoir comprising a solid kerogen organic polymer to form a kerogen-derived oil, wherein the tight shale comprises a porosity of 4 to 12 vol %; and reacting the injected combustion product with the kerogen-derived oil to generate a second oil lighter than the kerogen-derived oil, methane and a surfactant.

2. The process as recited in claim 1, wherein the water of the combustion product is at a supercritical state.

3. The process as recited in claim 1, wherein the methane is pressurized.

4. The process as recited in claim 1, wherein the combusting causes the combustion product to have a velocity of at least approximately 150 ft/s.

5. The process of claim 4, wherein the combusting is performed in conjunction with a film cooling of a combustor.

6. The process as recited in claim 1, wherein the surfactant comprises carboxylic acid.

7. A tight-shale oil production tool for tight-shale, the production tool comprising:

a combustor operable to generate aqueous-phase nitric acid ($HNO_3$ (aq)) combustion products, wherein said combustor is fueled by a fuel and an oxidizer at stoichiometric combustion conditions and the combustion products have a pressure of at least approximately 10 k psi, wherein the tight shale comprises a solid kerogen organic polymer and wherein the tight shale comprises a porosity of 4 to 12 vol %.

8. The tool as recited in claim 7, wherein said oxidizer is oxygen ($O_2$ (g)).

9. The tool as recited in claim 7, wherein said fuel is an anhydrous ammonia ($NH_3$).

10. The tool as recited in claim 7, wherein said fuel is methane.

11. The tool as recited in claim 10, wherein said combustor receives a water nitric acid mixture with said methane.

12. The tool as recited in claim 7, wherein said fuel is hydrogen.

13. The tool as recited in claim 12, wherein said combustor receives a water nitric acid mixture with said hydrogen.

14. The tool as recited in claim 7, wherein said combustion products are expelled at a temperature of about 700 F (371 C).

15. The tool as recited in claim 7, wherein said combustion products are expelled at a temperature greater than about 700 F (371 C).

16. The tool as recited in claim 7, further comprising:

an injection manifold upstream of said combustor; and a quench zone downstream of said combustor to direct combustion products therefrom radially outward.

17. A method of oil production from a tight shale reservoir, comprising:

positioning a tight-shale oil production tool between two adjacent fracked and propped radial cracks, wherein tight shale comprises a solid kerogen organic polymer and wherein the tight shale comprises a porosity of 4 to 12 vol %;

operating the tight-shale oil production tool to introduce an aqueous-phase nitric acid ($HNO_3$ (aq)) into the two adjacent fracked and propped radial cracks and to heat the shale;

allowing the heated shale to sit for a static soak period such that a strong nitric acid ($HNO_3$ (aq)) will react with a kerogen-derived oil phase to produce carboxylic acid ($H(—CH_2-)_s$ COOH) and weak nitrous acid ($HNO_2$ (aq)) as a surfactant for lowering the surface tension between the oil and aqueous phases; and generating a driving pressure from generated methane and carbon dioxide gases produced during the static soak period to pressures in excess of 12,000 psi (816 atm).

18. The method as recited in claim 17, further comprising operating the tight-shale oil production tool for a period of 6 to 10 days in a heating operation.

19. The method as recited in claim 17, further comprising transporting pressurized oil, gas and aqueous brine through a production well casing for transport to a well surface.

* * * * *